United States Patent [19]

Traenkle

[11] 4,106,126

[45] Aug. 15, 1978

[54] WITHIN-THE-SHOE SOCK HAVING REMOVABLE RETAINING DEVICE

[76] Inventor: William J. Traenkle, 61 Old Ox Rd., Manhasset, N.Y. 11030

[21] Appl. No.: 823,623

[22] Filed: Aug. 11, 1977

Related U.S. Application Data

[63] Continuation-in-part of Ser. No. 589,444, Jun. 23, 1975, Pat. No. 4,055,858.

[51] Int. Cl.[2] ..... A41B 11/00; A43B 3/10; A43C 9/00

[52] U.S. Cl. ..... 2/240; 36/10; 24/143 B; 2/DIG. 6

[58] Field of Search ..... 2/239, 240, 61, 243; 36/10, 50; 24/140, 143 A, 143 B, 204; 66/182, 171; 428/4, 5; D2/330

[56] References Cited

U.S. PATENT DOCUMENTS

| | | | |
|---|---|---|---|
| 3,000,013 | 9/1961 | Traenkle | 2/240 |
| 3,104,479 | 9/1963 | D'Amico | 2/DIG. 6 |
| 3,315,276 | 4/1967 | Daxe | 2/61 |
| 3,955,246 | 5/1976 | Tanaka | 24/204 |
| 4,055,858 | 11/1977 | Traenkle | 2/240 |

*Primary Examiner*—Patrick D. Lawson

*Attorney, Agent, or Firm*—McAulay, Fields, Fisher & Goldstein

[57] ABSTRACT

A within-the-shoe sock construction is provided which comprises a sock having a foot opening adapted to receive a foot therethrough. The height of the sock is substantially coextensive with the height of the shoe to be worn with the sock whereby the upper rear edge of the sock is substantially coterminous with the upper rear edge of the shoe. Retaining means is provided which comprises an enlarged member, which may be in the form of a pompon, and a relatively narrow supporting member, which may be in the form of a ribbon, is connected to the enlarged member. The enlarged member is adapted to be disposed outside the shoe and in engagement therewith to prevent downward movement of the sock. Connecting means in the form of a press-on peel-off separable fastener is provided for detachably connecting the support member to the sock so that the retaining device may be interchanged or replaced with other retaining devices.

9 Claims, 15 Drawing Figures

WITHIN-THE-SHOE SOCK HAVING REMOVABLE RETAINING DEVICE

CROSS-REFERENCE TO RELATED APPLICATION

This application is a continuation-in-part of my copending application Ser. No. 589,444, filed June 23, 1975, now U.S. Pat. No. 4,055,858 entitled "Within-The-Shoe Sock Having Removable Retaining Device."

BACKGROUND OF THE INVENTION

The present invention relates generally to a within-the-shoe sock construction and, more particularly, pertains to a removable retaining device that maintains the sock in position on the foot of the wearer so that the retaining device may be interchanged or replaced.

So-called anklet type sock constructions are, for all intents and purposes, useless to a person engaged in a sporting activity. For example, the physical exertion and movement of a person playing tennis usually cause the anklets to fall down about the ankle of the wearer. Additionally, a greater disadvantage is due to the fact that as the person moves about a tennis court, the action of the shoe on the sock tends to pull the sock down into the shoe. As a result the shoe must periodically be removed so that the socks can be readjusted.

The aforementioned problem was elminated by the invention disclosed and claimed in my U.S. Pat. No. 3,000,013, issued Sept. 19, 1961 and entitled "Within-The-Shoe Sock." As disclosed therein, a within-the-shoe sock was provided. Such socks have a height that is substantially coextensive with the height of the shoe and have a top edge that is substantially coterminous with the edge of a shoe. A retaining device is provided in the form of an enlarged member that is adapted to be disposed on the outside of the shoe and in snug engagement therewith to prevent the sock from riding down into the shoe. A narrow connecting member connects the enlarged member to the sock. This type of sock construction eliminates all the problems associated with the anklet type sock constructions particularly for those people engaged in sporting activities such as tennis, golf, etc., and, as a result, sales of such within-the-shoe sock constructions have been expanding at a geometric rate.

Under normal circumstances, the aforementioned within-the-shoe sock constructions are purchased by the consumer from the manufacturer through a sales outlet. Usually, the enlarged members are in the form of brightly colored pompons that are sewn to the rear edge of the sock. Many times the wearer desires the color of the pompons to match the color of the outfit they are wearing. Hence, if the wearer has a number of differently colored outfits, she will have to purchase a corresponding number of socks having respective colors that compliment her outfit. Additionally, if a pompon is detached from the sock during play, the pompon may be lost thereby necessitating the purchase of a new pair of socks.

Accordingly, an object of the present invention is to provide an improved within-the-shoe sock.

A more specific object of the invention is the provision of a within-the-shoe sock having retaining devices that are connected to the sock by press-on peel-off separable fasteners so that the retaining devices easily may be interchanged or replaced.

Another object of the present invention is to provide a within-the-shoe sock construction wherein the retaining device may easily be attached or detached from the sock per se without the need for additional tools.

A further object of the present invention resides in the novel details of construction that provide a retaining device for a within-the-shoe sock construction that can be packaged separately and apart from the sock per se.

SUMMARY OF THE INVENTION

Accordingly, a within-the-shoe sock construction constructed in accordance with the present invention comprises a sock having a foot opening adapted to receive a foot therethrough. The height of the sock is substantially coextensive with the height of the shoe to be worn with the sock and the upper rear edge of the sock is substantially coterminous with the upper rear edge of the shoe. Retaining means is provided that is engageable with the rear edge of the shoe for retaining the sock in position on the foot of the wearer. The retaining means comprises an enlarged member and a relatively narrow support member between the enlarged member and the rear of the sock. A press-on peel-off separable fastener is provided between the sock and the narrow member for detachably connecting the retaining means to the sock to permit the easy replacement or interchanging of the retaining device.

BRIEF DESCRIPTION OF THE DRAWINGS

Other features and advantages of the present invention will become more apparent from a consideration of the following detailed description when taken in conjunction with the accompanying drawings, in which.

DESCRIPTION OF THE PREFERRED EMBODIMENTS

Figures 1, 2A, 2B, 3, 4A, 4B, 5, 6A, 6B, 7, 8:
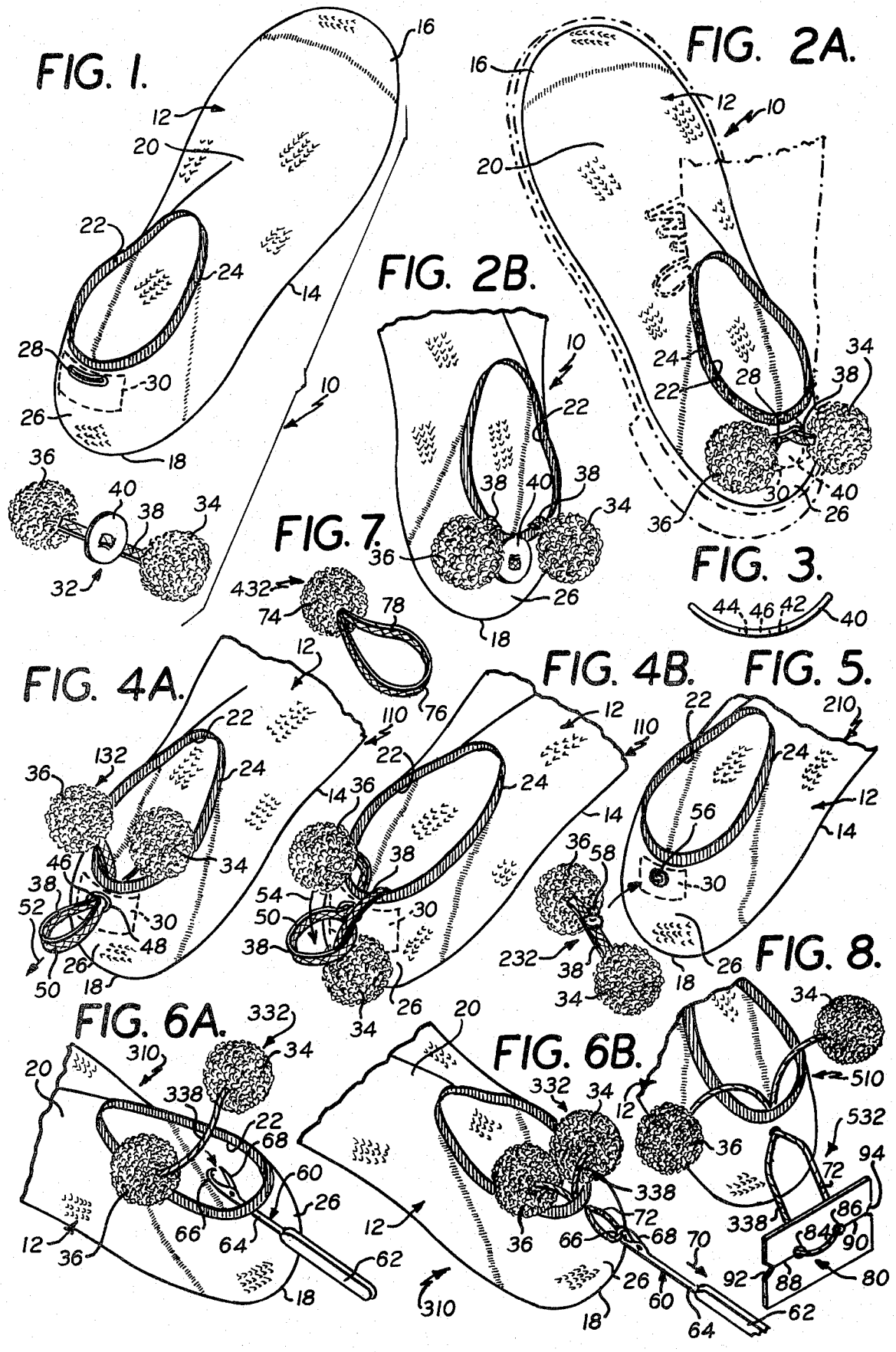
FIG. 1 is an exploded perspective view, as viewed from the rear, showing the sock construction and retaining device constructed according to the present invention.
FIG. 2A is a perspective view similar to FIG. 1, showing the retaining device connected to the sock per se.
FIG. 2B is a detailed view of the rear portion of the sock construction similar to that shown in FIG. 2A, illustrating an alternative connection arrangement.
FIG. 3 is a top plan view of a button of the type used to detachably connect the retaining device to the sock.
FIGS. 4A and 4B are detailed views showing the sequence of attaching a modified embodiment of a retaining device to the sock.
FIG. 5 is a detailed view of a further modified embodiment of a sock construction utilizing still another retaining device.
FIGS. 6A and 6B are detailed views illustrating the sequence of detachably connecting yet another modified embodiment of a retaining device.
FIG. 7 is a further modified embodiment of a retaining device that may be utilized in conjunction with the sock shown in FIG. 1.
FIG. 8 is a perspective view of still another modified embodiment of a retaining device for use with the sock shown in FIG. 1.

Accordingly, a sock construction constructed in accordance with the present invention is designated generally by the reference character 10 in the FIGS. and includes a within-the-shoe sock 12. As noted hereinabove, a within-the-shoe sock has a height that is substantially equal to the height of the shoe and terminates substantially at the edge of the shoe so that the sock does not extend above the shoe of the wearer. More specifically, the sock 12 includes a sole portion 14, a toe portion 16, a heel portion 18, and an instep portion 20. The sock is provided with a foot opening 22 through which the foot of the wearer is received. The edges of the sock surrounding the opening 22 may be reinforced as by a decorative shell stitch 24 or the like. The sock may be knit of any desired type of yarn and may include the stretch-type yarn or blends of yarn. The sock is preferably made seamless and of relatively heavy yarn and may have a cushion sole, heel and toe or a laminated or a double layer construction of soft yarns or, in the alternative, may have a terry-toe construction. An elastic band or elastic stitching or the like may be provided at the periphery of the opening 22.

The rear portion 26 of the sock is provided with a horizontally extending button hole 28 that is substantially centrally located on the rear portion and is positioned slightly below the opening 22. That is, the button hole 28 is located just below the upper rear edge of the sock. Additionally, a reinforcing panel or cover of material 30 may be attached to the rear portion 26 of the sock on the inner surface thereof and connected to the rear portion by stitching along the edges of the panel. The stitches are spaced from the button hole 28 to provide a pocket which receives a button through the button hole. The panel 30 prevents the button from abrading the foot of the wearer.

The retaining device is designated generally by the reference character 32 and basically comprises an enlarged member and a narrow supporting member that supports the enlarged member on the sock. More specifically, as shown in FIG. 1, the enlarged member comprises a pair of pompons 34 and 36 that are connected together by a relatively narrow flat ribbon 38. That is, the ribbon 38 is the narrow supporting member and has one end connected to the pompon 34 and the other end connected to the pompon 36. The pompons may be attractively colored so as to coordinate with various outfits. In a preferred embodiment, the minimum diameter of the pompons is $1\frac{1}{4}$ inches and the pompons are made of wool or other washable material. The ribbon width is $\frac{1}{8}$ inch.

Received on the ribbon 38 is a button 40. As shown in FIG. 3, the button 40 may be arcuate in shape to conform to the curvature of the back of the foot and is wafer thin so that it will not cause any rubbing of the foot. Centrally located on the button are spaced openings 42 and 44 through which the ribbon 38 extends. That is, the ribbon 38 extends in one direction through the opening 42, about a post 46 separating the openings 42 and 44 and through the opening 44 in the opposite direction so that the button 40 is movable on the ribbon 38.

The retaining device 32 is releasably secured to the sock 10 by inserting the button 40 into the button hole 28 as shown in FIG. 2A. That is, as shown in the FIG., the ribbon or supporting member 38 extends through the button hole 28 and the button 40 is received on the interior of the sock. The ribbon 38 is of sufficient length so that when the foot of the wearer is placed into a shoe, the pompons 34 and 36 will extend above the rear edge of the shoe and will be snug engagement therewith to effectively prevent the sock from being pulled down into the shoe as the wearer begins to walk or exercise.

Alternatively, the reinforcing panel 30 may be eliminated from the sock construction. The button 40 may be placed through the button hole 28 from the interior of the sock outwardly so that the button 40 resides on the outer surface of the rear portion 26, as shown in FIG. 2B. In this latter construction, the ribbon 38 will extend upwardly along the interior of the sock and outwardly over the rear edge of the opening 22. For this latter arrangement, the rear portion of the sock will serve to insulate the button from the foot of the wearer.

It will now be obvious that the construction shown in FIGS. 1–3 provides a retaining device that may be releasably or detachably secured to the sock per se thereby permitting differently colored pompons to be connected to the same sock 12 without the necessity for purchasing entire sock constructions. Additionally, if one of the pompons is separated from the ribbon 38, the damaged retaining device may be removed and a new retaining device easily connected to the sock 12.

A modified embodiment of the present invention is illustrated in FIGS. 4A and 4B wherein reference numerals similar to those shown in FIGS. 1–3 indicate identical elements. The sock construction 110, shown in FIGS. 4A and 4B include a sock 12 which is similar in construction in all respects to the sock 12 shown in FIGS. 1–3 with the exception that the sock of FIGS. 4A and 4B is provided with an opening 46 on the rear portion 26 rather than a button hole. The opening 46 may be centrally positioned on the rear portion just below the foot opening 22 of the sock so that the opening is just below the upper rear edge of the sock. The opening may be reinforced by a grommet 48 or the like and optionally the reinforcing panel 30 may be provided. However, it is to be understood that the opening would also extend through the reinforcing panel. The retaining device 132 is identical in construction to the retaining device 32 with the exception that no button is provided on the ribbon 38.

When it is desired to secure the retaining device 132 to the sock 12 of the construction 110, the ribbon 38 is folded to form loop 50 which is then inserted through the opening 46 in the direction of the arrowhead 52 (FIG. 4A) from the interior to the exterior of the sock. The ends of the ribbon are then extended from the interior of the sock over the upper rear edge of the opening 22 and the pompons 34 and 36 are inserted through the loop in the direction of the arrowhead 54 of the FIG. 4B. The pompons may then be pulled to tighten the ribbon 38 and form a knot. Similarly to the construction shown in FIGS. 1–3, the ribbon 38 is of sufficient length so that when the retaining device 132 is connected to the sock 12, the pompons will be in snug engagement with the upper rear edge of the shoe. When it is desired to remove the retaining device 132, the loop 50 is pulled outwardly and the pompons are withdrawn from the loop.

A further modified embodiment of the present invention is shown in FIG. 5 and includes a construction 210 that is similar to the construction shown in FIGS. 1-3 with the exception that a snap fastener is utilized to detachably secure the retaining device 232 to the sock rather than a button. That is, as shown in FIG. 5, the female portion 56 of a snap fastener is connected to the sock 12 just below the upper rear edge of the opening 22 of the sock on the rear portion 26 thereof. The male section 58 of the fastener is substantially centrally located on the ribbon 38 and is adapted to be received in the female section 56 to releasably or detachably secure the retaining device 232 to the sock 12. It is to be understood that the elements 56 and 58 of the snap fastener are relatively thin so that they do not interfere or cause abrasion to the foot of the wearer.

FIGS. 6A and 6B illustrate a further modified embodiment of a sock construction of the present invention. Thus, in the sock construction 310 shown in FIGS. 6A and 6B, the sock 12 is not provided with an opening on the rear portion 26. However, a needle 60 is provided that is similar in construction to needles utilized in circular knitting machines. The needle 60 includes a handle 62 and a shank 64 that terminates in a hook or eye 66 at the end thereof. A closure piece 68 is pivotally connected to the shank 64 and is adapted to be moved to an open position wherein the hook 66 is accessible and a closed position as shown in FIG. 6B. In the closed position, the closure piece 68 follows the contour of the hook 66 so that the needle will not grab on the sock fabric as it is withdrawn in the direction shown by the arrowhead 70 in FIG. 6B.

The retaining device 332 of the contruction 310 is similar in construction to the retaining device 132 with the exception that the flat ribbon 38 that connects the pompons 34 and 36 has been replaced by a circular or a tubular ribbon or cord 338.

In operation, the needle 60 is inserted through the fabric of the material comprising the sock 12 at a point spaced just below the upper rear edge of the sock, as shown in FIG. 6A. The closure piece 68 is pivoted to the open position and the ribbon 338 is engaged in the hook 66. The closure piece 68 is then moved to the closed position and the needle withdrawn thereby drawing a loop 72 of the ribbon through the fabric. The needle 60 is then detached from the loop 72 by opening the closure piece 68 and disengaging the hook 66 therefrom. The retaining device 332 may then be releasably affixed in place in the same manner as the retaining device 132 of the construction 110 shown in FIGS. 4A and 4B.

FIG. 8 illustrates a further modified embodiment of a sock construction 510 that is provided with a retaining device 532. The retaining device 532 is similar to the retaining device 332 and comprises pompons 34 and 36 interconnected by a tubular ribbon 338. The ribbon 338 is inserted through the rear of the sock 12 in a manner such as that described in conjunction with the embodiment of FIGS. 6A and 6B. Alternatively, the loop 72 may be passed through an opening such as the opening 46 shown in FIGS. 4A and 4B.

A member 80 is provided that may be removably connected to the loop 72 to prevent the loop from passing back through the rear of the sock 12 thereby to releasably retain the elements 34, 36 and 338 in place. More specifically, the member 80 may be fabricated from a thin plastic or the like and comprises generally a rectangularly shaped plate 82 having spaced apertures 84 and 86, although any shape of plate may be utilized. Thin slits 88 and 90 extend from the respective apertures 84 and 86 to the respective side edges of the plate and terminate thereat at notches 92 and 94.

The member 80 is connected to the loop 72 by inserting one side of the ribbon 338 defining the loop into the notch 92 and sliding the ribbon along the slit 88 until the ribbon is received in the aperture 84. Similarly, the other side of the ribbon defining the loop 72 is inserted into the notch 94 and slid along the slot 90 until it is received in the aperture 86. As shown in FIG. 8, the loop 72 is arranged so it extends through the apertures 84 and 86 and across the outer surface therebetween. The slits 88, 90 are sufficiently small as compared to the size of the ribbon 338 so that the ribbon is captured within the apertures 84, 86. That is, the ribbon can only be removed from the apertures manually be reversing the above procedure. Accordingly, the arrangement shown in FIG. 8 permits use of a single member 80 in conjunction with a plurality of differently colored pompons and respective connecting ribbons to releasably connect any desired one of pompon constructions to the sock.

Another modified embodiment of a retaining device is shown in FIG. 7 wherein the retaining device 432 comprises a single pompon 74 and a ribbon 76 the ends of which are attached to the pompon thereby forming a loop 78. The retaining device 432 may be connected to the sock 12 in the same manner as any one of the retaining devices described hereinabove. That is, a button 40 may be provided on the ribbon 76 as in the constructions shown in FIGS. 1-3, or the loop 78 may be inserted through an opening or pulled through the sock fabric as in the constructions shown in FIGS. 4A and 4B, or 6A and 6B. Alternatively, the ribbon 76 may be provided with a snap fastener as in the construction shown in FIG. 5.

Figure 9:
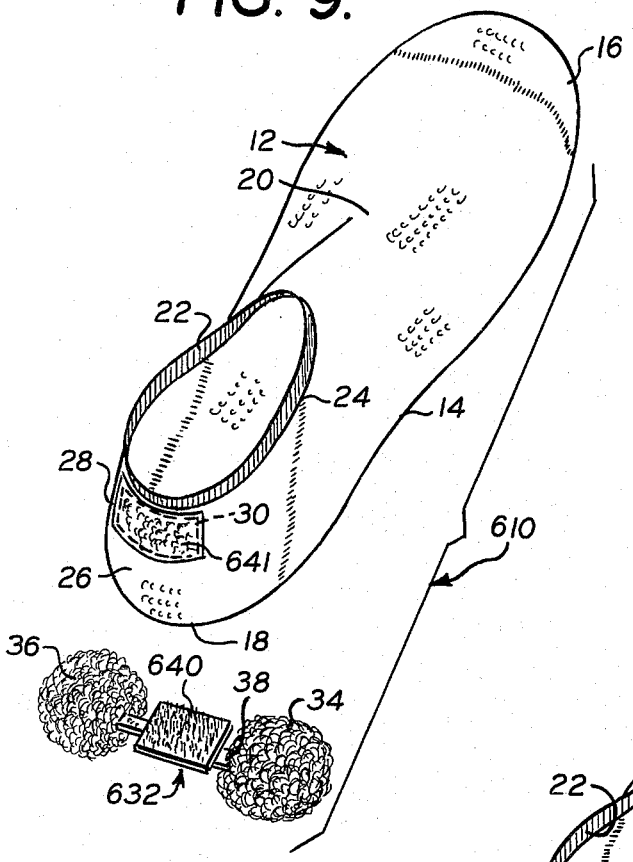
FIG. 9 is an exploded perspective view, as viewed from the rear, showing a further modified embodiment of a sock construction and retaining device constructed according to the present invention.
Figure 10:
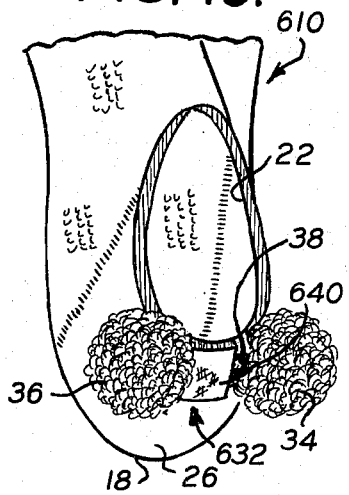
FIG. 10 is a perspective view similar to FIG. 1, showing the retaining device connected to the sock per se.

A still further modified embodiment of a sock construction is illustrated in FIG. 10 wherein similar reference characters in the various indicate identical elements. Accordingly, FIGS. 9 and 10 illustrate a sock construction 610 that includes a retaining device 632. The retaining device 632 comprises pompons 34 and 36 interconnected by a ribbon 38. Received on the member 38 is a section 640 of a press-on peel-off type of separable fastener. Received on the rear portion 26 of the sock 12 is a rectangular section 641 that is adapted to mate with the section 640. In other words, the separable fastener elements 640 and 641 may comprise a Velcro-type fastener wherein the elements comprising the fastener are connected together by simply applying a slight pressure to the elements.

More specifically, the section such as section 640 may comprise a plurality of outwardly extending hooks that are adapted to interengage with outwardly projecting loops on the section 641 to securely connect the retaining device with the sock and still provide a means for easily separating the retaining device therefrom by simply peeling apart the sections 640 and 641 of the separable fastener.

While a Velcro-type fastener has been specifically referred to above, it is to be noted that this is for illustrative purposes only and is not to be deemed a limitation on the present invention. That is, any type of press-on pull- or peel-off type of separable fastener may be used. For example, the type of fastener shown in U.S. Pat.

Figure 12:
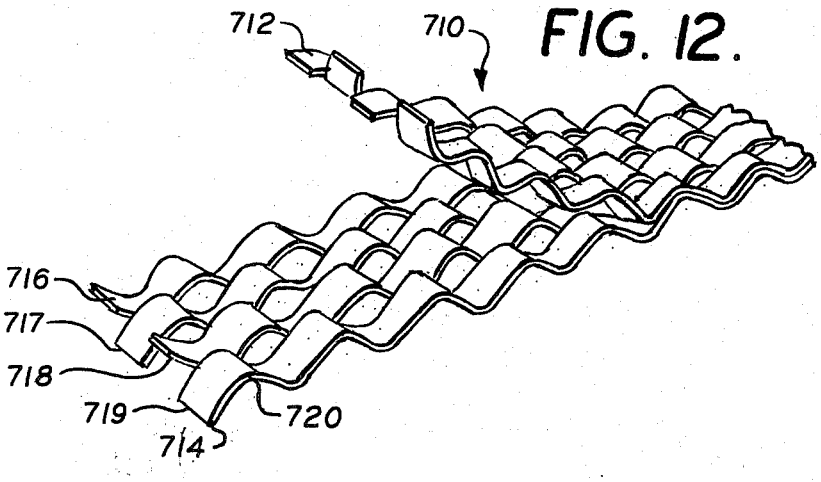

No. 3,955,246 may ideally be used in the present invention. FIG. 12 illustrates such separable fastener which is designated generally by the reference numeral 710 and which comprises a plurality of undulating strips 716–720 which are connected together at their crossover points. Adjacent strips are arranged so that the uppermost point on one strip is aligned with the lowermost point on the next adjacent strip. A complimentary formed member 712 is provided which is identical in construction to the lower strip 714. When the strips are pressed together, they are arranged so that the troughs of the upper strip 712 will be superimposed on the troughs of the strips forming the lower member 714. Additionally, the width of the strips is sized so that the members will be retained together by the friction between the side edges of the strips of the upper and lower members.

Figure 11:
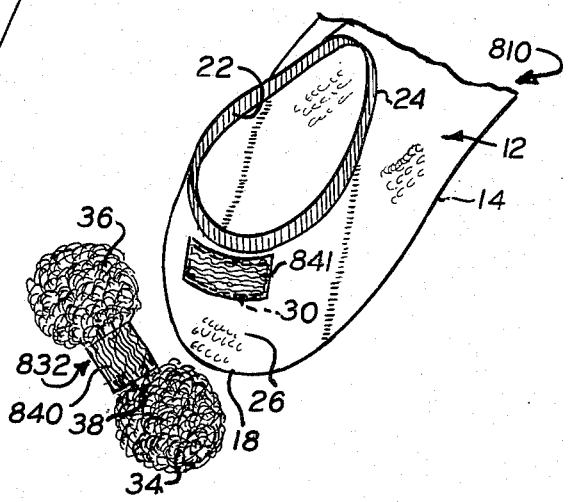
FIG. 11 is a detail view of another modified embodiment of a sock construction utilizing an alternate form of retaining device; and, FIG. 12 is a plan view, to an enlarged scale, of the press-on peel-off separable fastener shown in FIG. 11.

Accordingly, FIG. 11 illustrates a sock construction 810 having a retaining device 832 that is provided with a member 840 similar in construction to the member 714 additionally, the rear portion 26 of the sock is provided with a member 841 similar in construction to the member 712. Accordingly, the retaining device 832 may be connected to the sock simply by pressing together the members 840 and 841. Additionally, these members may be separated simply by peeling them apart in the conventional manner.

Accordingly, a within-the-shoe sock construction has been disclosed wherein a retaining device is releasably secured to the sock per se so that the retaining device may be easily interchanged to suit the needs of the wearer without requiring the purchase of the entire construction.

While preferred embodiments of the invention have been shown and described herein it will become obvious that numerous omissions, changes and additions may be made in such embodiments without departing from the spirit and scope of the present invention.

What is claimed is:

1. A within-the-shoe sock construction comprising a sock having a foot opening adapted to receive a foot therethrough, the height of said sock being substantially coextensive with the height of a shoe to be worn with said sock whereby the upper rear edge of the sock is substantially coterminous with the upper rear edge of the shoe; retaining means detachably securred to said sock and engagable with the rear edge of a shoe for retaining said sock in position on the foot of the wearer, said retaining means comprising an enlarged member, and a relatively narrow support member connected to said enlarged member; and a press-on peel-off separable fastener on said sock and said support member for detachably connecting said retaining means to said sock.

2. A within-the-shoe sock construction as in claim 1, in which said separable fastener comprises a plurality of hooks on one of said support member and said sock, and a plurality of loops on the other of said support member and said sock interengagable with said plurality of hooks to detachably secure said retaining means to said sock.

3. A within-the-shoe sock construction as in claim 1, in which said separable fastener comprises a first member on said support member comprising a plurality of joined undulating strips wherein the lowermost point of one strip is aligned with the uppermost point of the adjacent strip, and a complementary formed second member on said sock interengagable with said first member to detachably secure said retaining means to said sock.

4. A within-the-shoe sock construction as in claim 1, in which said enlarged member comprises a pair of pompons and said narrow connecting member comprises a ribbon connecting together said pair of pompons.

5. A within-the-shoe sock construction as in claim 1, in which said enlarged member comprises a pompon, and said narrow support member comprises a ribbon having the ends thereof secured to said pompons.

6. Detachable retaining means for retaining in position on the foot of the wearer a within-the-shoe sock of the type having a foot opening adapted to receive a foot therethrough, the height of the sock being substantially coextensive with the height of a shoe to be worn with the sock whereby the upper rear edge of the sock is substantially coterminous with the upper rear edge of the shoe; said retaining means comprising an enlarged member adapted to be disposed outside of the shoe and in engagement therewith to prevent downward movement of said sock, and a narrow support member connected to said enlarged member; and a press-on peel-off separable fastener having a first section connected to said retaining means and a second interengagable section adapted to be connected to said sock for removably securing said retaining means on said sock.

7. Detachable retaining means as in claim 6, in which said first section comprises a plurality of hooks, and said second member comprises a plurality of loops interengagable with said plurality of hooks.

8. Detachable retaining means as in claim 6, in which said enlarged member comprises a pair of pompons, and said narrow connecting member comprises a ribbon connecting together said pair of pompons.

9. Detachable retaining means as in claim 6, in which said enlarged member comprises a pompon, and said narrow support member comprises a ribbon having the ends thereof secured to said pompon.

* * * * *